US005368702A

United States Patent [19]

de Nora

[11] Patent Number: 5,368,702

[45] Date of Patent: Nov. 29, 1994

[54] ELECTRODE ASSEMBLIES AND MUTIMONOPOLAR CELLS FOR ALUMINIUM ELECTROWINNING

[75] Inventor: Vittorio de Nora, Nassau, Bahamas

[73] Assignee: MOLTECH Invent S.A., Luxembourg

[21] Appl. No.: 64,031

[22] PCT Filed: Nov. 20, 1991

[86] PCT No.: PCT/EP91/02219

§ 371 Date: May 25, 1993

§ 102(e) Date: May 25, 1993

[87] PCT Pub. No.: WO92/09724

PCT Pub. Date: Jun. 11, 1992

[30] Foreign Application Priority Data

Nov. 28, 1990 [EP] European Pat. Off. ... EP90810926.7

[51] Int. Cl.[5] ..... C25C 3/06; C25C 3/12

[52] U.S. Cl. ..... 204/67; 204/247; 204/280; 204/290 R; 204/272; 204/284

[58] Field of Search ..... 204/243 R, 247, 272, 204/290 R, 280, 279, 284, 67

[56] References Cited

U.S. PATENT DOCUMENTS

| | | | |
|---|---|---|---|
| 3,024,174 | 3/1962 | Stetson | 204/247 |
| 4,054,433 | 9/1983 | Payne | 204/225 |
| 4,392,925 | 7/1983 | Alder et al. | 204/67 |
| 4,397,729 | 8/1983 | Duruz et al. | 204/243 R |
| 4,647,405 | 3/1987 | Debely | 252/518 |
| 4,680,094 | 7/1987 | Duruz | 204/67 |
| 4,966,074 | 10/1990 | Aldrich, Jr. | 101/177 |

FOREIGN PATENT DOCUMENTS

| | | |
|---|---|---|
| 0030834 | 6/1981 | European Pat. Off. . |
| 0114085 | 7/1984 | European Pat. Off. . |
| 0126555 | 11/1984 | European Pat. Off. . |
| 0203834 | 12/1986 | European Pat. Off. . |
| 0215590 | 3/1987 | European Pat. Off. . |
| 0306089 | 3/1989 | European Pat. Off. . |
| 0308014 | 11/1992 | European Pat. Off. . |
| 0308013 | 5/1993 | European Pat. Off. . |
| 1374037 | 4/1964 | France . |
| 2482629 | 5/1981 | France . |

*Primary Examiner*—Kathryn Gorgos
*Attorney, Agent, or Firm*—John J. Freer

[57] ABSTRACT

A multimonopolar cell for electrowinning aluminium by the electrolysis of alumina dissolved in a molten salt electrolyte, comprises electrode assemblies each having a non-consumable anode and a non-consumable cathode both resistant to attack by the electrolyte and by the respective product of electrolysis. The anode (2) is preferably of tubular form with an active anode surface (7) inside, and the cathode is made of one or more rods (1) or tubes placed in the middle of the tubular anode or between plate anodes, the cathode extending beyond the bottom of the anode. The active anode surface area is bigger than the facing active cathode surface area. In use, the electrode assembly is partly immersed vertically or at a slope in the electrolyte (3) with the cathode dipping in a layer (4) of aluminum on the cell bottom. Liquid aluminium formed during electrolysis on the cathode surface drips or downflows to the bottom of the cell and oxygen evolved at the anode surface rises through the electrolyte and escapes at the top of the tubular anode. Current supply to the cathode rods is preferably through the cell bottom and the layer (4) of aluminium.

25 Claims, 5 Drawing Sheets

ELECTRODE ASSEMBLIES AND MUTIMONOPOLAR CELLS FOR ALUMINIUM ELECTROWINNING

FIELD OF THE INVENTION

The present invention relates to the electrowinning of aluminium by the electrolysis of alumina dissolved in a molten salt electrolyte.

BACKGROUND OF THE INVENTION

The electrowinning of aluminium from alumina dissolved in a molten salt, especially cryolite, involves unique and particularly severe materials problems linked with the corrosive conditions in the high temperature electrolyte and the reactivity of the anodically and cathodically released products.

Aluminium is still produced today by a process developed more than 100 years ago, which is called the Hall-Heroult process. In this process, both the cathode and the anode are made of carbonaceous materials.

No basic change has been made in the process despite considerable efforts by the aluminium industry and researchers to improve the process and cell design particularly by finding a substitute for carbon. All attempts to date to produce commercially-acceptable substitutes for carbon have failed: anodes are still being made of carbon in the form of pre-baked blocks or continuous Soderberg electrodes. The carbon cathodes form the bottom of the cell trough and are covered with a thick layer of aluminium which protects them from attack by cryolite and air. Even the walls of the cell are usually made of carbon and are protected by a crust of frozen cryolite. Recently, it has been proposed to replace part of the cell bottom and cell walls by other materials such as tabular alumina, see for example EP-A-0 308 013.

To find an acceptable substitute for the carbon anode seems to be an impossible task because the only materials that can resist the attack of oxygen at the temperature of electrolysis (almost 1000° C.) are oxides or oxycompounds, and all oxides are more or less soluble in cryolite which was chosen particularly because aluminium oxide is soluble in cryolite.

Certain conductive ceramics can be utilized as anode structures or as anode substrates protecting anode metallic structures by having on their surface a self-sustained cerium oxide or oxyfluoride deposit which may be formed and maintained on the surface of an oxygen-evolving anode, thereby protecting the anode structure or substrate from attack by cryolite. See for example European Patents EP-B-0,114,085, EP-B-0,203,834 and U.S. Pat. Nos. 4,680,094 and 4,966,074.

Other non-consumable or only slowly consumable non-carbon anodes are for example described in European Patent EP-B-0,030,834 and U.S. Pat. No. 4,397,729.

However, the utilization of these non-carbon, non-consumable anodes has been delayed by the difficulties of retrofitting existing cells and of designing new cells in which they could be used.

To find a substitute for the carbon cathodes has been just as difficult because the only material so far found to be acceptable is titanium diboride which must be very pure and is too costly. Also, the proposed cell designs using this material have not been proven in practice.

The design of existing cells has thus remained somewhat primitive and technically inefficient and no basic improvements in the process have been made in the last 100 years, mainly due to the limitations imposed by the carbon anodes having a short life and large dimensions. However, cells of higher capacity with lower power consumption and better gas collection have been built.

Pollution remains a major problem in the operation of even the most modern cells: the pollution extends from the fabrication of pre-baked carbon blocks or from the operation of Soderberg electrodes, right through to the disposal of used carbon cathodes which are impregnated with difficult-to-dispose-of materials including cyanides.

In the conventional cells, there is non-uniform current distribution which creates irregular strong magnetic fields that produce various unwanted effects, including surface wave displacements of the thick aluminium pool at the bottom of the cell. For this reason, the anode, which is frequently replaced, cannot be held near to the cathode, resulting in a high voltage drop through the electrolyte which corresponds to approximately two-thirds of the total ohmic drop in a cell.

SUMMARY OF THE INVENTION

The invention proposes a revolutionary design of a multimonopolar cell and an electrode assembly for aluminium electrowinning which permits reduction of pollution, reduction of the ohmic drop particularly through the electrolyte, simplification of the trough lining for new cells which does not need to be conductive of current, simplification of the electrodes' current connections, reduction of the current density at the surface of the anode and in the electrolyte, reduction of the power consumption, and a considerable reduction of the costs of building and operating an aluminium production cell. Many of these advantages are also available for retrofitting existing cells.

To achieve these advantages, the invention uses electrodes assemblies made of non-consumable anodes and cathodes arranged practically vertically or at a slope and provides a multimonopolar cell for the electrowinning of aluminium by electrolysis of alumina dissolved in a molten salt electrolyte, as well as a novel method of electrowinning.

The invention provides a multimonopolar cell for aluminium electrowinning by the electrolysis of alumina dissolved in a molten salt electrolyte, comprising a plurality of electrode assemblies electrically connected in parallel; these electrode assemblies comprising substantially non-consumable anodes made of electrically conductive material resistant to the electrolyte and to the anodically produced oxygen and substantially non-consumable cathodes made of electronically conductive material resistant to the electrolyte and to the cathodically produced aluminium. The electrode assemblies are placed substantially upright in the cell or at a slope which is usually steeper (i.e. less) than 45° to the vertical, in many cases 30° or less to the vertical. In use, cathodically produced aluminium downflows while anodically produced oxygen escapes towards the top. This cell is characterized in that each electrode assembly comprises one or more cathodes having an active cathode surface facing and surrounded by or in between one or more anodes having an inwardly-facing active anode surface, said inwardly-facing active anode surface having an area which is greater than the active surface area of the cathode, and the cathodes extending beyond the bottom of the anodes and preferably being in electrical contact with the cell bottom, via the aluminium layer, or directly in contact with a drained cell bottom of conductive material.

The electrode assemblies used in the invention comprise at least one substantially non-consumable anode and at least one substantially non-consumable cathode both resistant to attack by the electrolyte and by the products of electrolysis. Each anode has one or more sections preferably of tubular form with the active anode surface inside, and each cathode may be an elongate body such as a rod, tube, bar, slab or similar piece placed inside, preferably at the center of each surrounding anode section or several rods or pieces placed in the middle of the surrounding anode, with the active cathode surface facing the inner surface of the surrounding anode. The cathode extends beyond the bottom of the anode and may also extend beyond the top. In use, the electrode assembly is partially or completely immersed generally vertically or at a slope in the electrolyte whereby liquid aluminium formed during electrolysis on the cathode surface can drip or flow down to the bottom of the cell and gases evolved at the anode surface can rise through the electrolyte and escape at the top or through openings in the sides of the anode sections.

Any number of such electrode assemblies may be connected in parallel in the same cell trough to make up a multimonopolar cell.

Electrode assemblies consisting of a tubular anode and a central cathode can have the current connections from the busbars both to the cathode and to the anode made at the top. In this case, the part of the cathode and/or of a cathode current feeder protruding above the electrolyte and above the top of the anode is made of or coated with a material resistant to the anode product of electrolysis, i.e. oxygen possibly containing other components of the electrolyte.

When the product aluminium is permanently drained, the bottom of the cathode can contact an electrically conductive cell bottom which usually will incorporate current-feeder bars. However, particularly in existing cells utilizing a conductive cathode cell bottom covered by an aluminium layer, the electrical connection to the cathode rod can be made by dipping the lower end of the the cathode into the liquid aluminium pool existing at the cell bottom. To maintain a constant distance between the anode and cathode, spacers or other means have to be provided. The length of the cathode will depend on the distance of the cryolite level from the cell bottom. By leaving the top end of the cathode below the level of the cryolite, the material of which it is made does not need to be particularly resistant to attack by the evolved oxygen, but only to attack by cryolite and by the aluminium produced on its surface.

The electrical connection to the anode can still be made at the top of the anode. Of course, the anodes are placed with their lower ends spaced above the cathodic pool of aluminium by a distance greater than the inter-electrode gap and sufficient to prevent short-circuits. The cathode, however, protrudes below the bottom of the anode and dips into the cathodic pool of aluminium, or at least contacts the conductive cell bottom in drained cells.

The oxygen outlet can take place through the top opening of the anode tube or section or through lateral openings provided in such tubes or sections making up the anode, above the level of cryolite.

A cover can be provided on the entire cell and anode tubes can be fitted into holes provided in such cover. In this case, the oxygen formed on the inside surface of the anode tube can escape from the top of the tube or be collected under the cover and leave through one or more openings provided in the cell cover.

When the electrical contacts are made at the top for the anodes and at the bottom for the cathodes, and a cathode rod, bar or tube is fitted in an anode tube of circular section, their cross-sectional area can be chosen in such a way that taking into account the resistivity of the two materials the linear voltage drop therein along the vertical axes could be substantially the same. In this way, a more uniform current density on the surface of the anode and of the cathode can be obtained. In particular, for a cathode of given specific resistivity and an anode of given specific resistivity in combination with a molten salt electrolyte of specific resistivity, the cross-sections and the spacing of the cathode and anodes could be chosen so that for any given current path between the anode and cathode the voltage drop remains substantially constant. The just-described arrangement is particularly suited to the retrofitting of existing aluminium production cells to convert them to operation as a multimonopolar cell according to the invention.

The anodes are preferably tubular. By tubular is meant any hollow cylindrical or other shape of round, square or polygonal cross-section usually having a central axis, but rectangular sections are not excluded. For instance, one tubular anode of rectangular section may receive several cathodes. The tubular anode bodies may be of uniform cross-sections along their length, or tapered. Usually, the tubular anodes will be made of a single piece, possible with slits or side openings partly along its length. Also, a tubular anode can be made of several pieces placed together or with small gaps therebetween. Thus, the inwardly-facing active anode surfaces inside the tubular anode bodies may be continuous or discontinuous. In variations of the invention, it is also possible to use substantially vertical anode plates with elongate cathodes in between. The distribution of current density in this case may not be uniform unless the horizontal cross-section of these plates is undulated to make the anode-cathode gap fairly uniform. The anode plates could also be placed at a slope to keep the oxygen escaping towards the top in contact with the anode. Cylindrical or regular polygonal anodes such as hexagonal or octogonal, can also be used and packed together.

The anodes and cathodes may be facing plates of substantially equal size, i.e. having the same geometrical surface area, the anodes, however, having a larger active surface area than the cathodes. In this case, the anodes may be porous, ribbed or louvered structures whose active surface area is greater than the geometrical area (sometimes called the "projected area"). The active anode surface area is usually at least 1.5 times greater than geometrical area, often 5 times or more greater.

The cathode may be a solid rod, bar, slab or a tubular piece surrounded by the anode or between the anodes, this tubular cathode piece possibly having openings in its wall for the circulation of electrolyte. The cathodes may be supported on the cell bottom by a holder which is advantageously removable from the cell together with the cathodes, thus facilitating replacement of the cathodes when necessary. Other arrangements for replacing the cathodes are, however, possible, for example, the cathodes could be supported by the anodes, or could be supported frm the top of the cell.

Another aspect of the invention is an electrolytic multimonopolar cell for the production of aluminium by the electrolysis of a molten salt electrolyte containing dissolved alumina, of the type comprising a plurality of substantially non-consumable anodes made of electronically conductive material resistant to the electrolyte and to the anode product of electrolysis and having an active anode surface, and a plurality of substantially non-consumable cathodes made of electronically conductive material resistant to the electrolyte and the cathodically produced aluminium. The anodes and cathodes are upright or at a slope, each cathode having an active cathode surface facing the active anode surface and from which, in use, cathodically produced aluminium drips or flows towards the cell bottom. This cell is characterized in that each cathode is surrounded by or in between one or more anodes of tubular or other convenient forms, having an inwardly-facing active anode surface having an area which is a multiple of the active surface area of the surrounded cathode. The cathodes extend beyond the bottom of the anodes and are in electrical contact with the cell bottom. The anodes may be made of sections which are assembled together and form a single body.

The anodes used in such a cell usually comprise at least one tubular section or body made of electronically conductive material resistant to the electrolyte and to the anode product of electrolysis and having on its inside an inwardly-facing active anode surface which, in use, surrounds one or more cathodes arranged along the middle of the tubular anode section, each tubular anode section being open at an upper end for the release of evolved gas and being open at a lower end for the passage of the electrowon metal and for the intake of circulating electrolyte, but the anode may also be flat or undulated plates between which the cathodes are placed. The walls of the anode sections also have openings for the circulation of electrolyte entrained with the evolved gas from inside the anode sections to outside. These openings may extend towards the top edge of the anode sections and be used for the escape of oxygen. To promote circulation of electrolyte, these openings may be situated below of electrolyte, these openings may be situated below or partly above the level of electrolyte. Preferably, the inwardly-facing active anode surfaces are made predominantly of cerium oxyfluoride, or have an outer surface which is an anchorage for in-situ deposited or maintained cerium oxyfluoride.

A multiple anode assembly according to the invention comprises a plurality of sections made of electronically conductive material resistant to the electrolyte, advantageously at temperatures below 900° C. and to the anode product of electrolysis; these sections being juxtaposable into a cellular structure having an array of tubular cavities, at least some of the tubular cavities having on their inside an inwardly-facing active anode surface. The other tubular cavities, without an inwardly-facing anode surface, may serve to the downward flow of the electrolyte. Oxygen may escape through the upper parts of such cavities or through the top of the anode cavities. Each section of the multiple anode assembly may already have one or more tubular cavities, or the tubular cavities can be formed by fitting together sections having complementary surfaces that make up tubular cavities when the sections are assembled.

The invention also proposes a method of electrowinning aluminium by the electrolysis of alumina dissolved in a molten salt electrolyte, advantageously at temperatures below 900° C. In this method, electrolysis current is passed between an upright or sloping cathode surrounded by an upright or sloping anode section, for instance a tubular anode section. Current is supplied to the anodes from the top and to the cathodes from the bottom. The current density at the inwardly-facing active anode surface inside the anode section is less than the current density at the cathode surface. Oxygen evolved at the active anode surface entrains with it an upward flow of electrolyte which generates circulation of the electrolyte, and aluminium produced on the cathode surface drips or flows to the cell bottom and is collected.

The anode active surface area and the current applied thereto are such that the resulting active anode surface current density is substantially lower than the limiting anode current for the evolution of oxygen so that oxygen can be produced preferentially to fluorine or other gases, even for low alumina concentrations, as resulting in "low" temperature electrolysis e.g. below 900° C.

A further aspect of the invention is the conversion of existing aluminium production cells by replacing the existing anodes with electrode assemblies as described above, whereby the cells are converted to multimonopolar operation.

Another inventive aspect concerns an electrolytic multimonopolar cell for the production of aluminium by the electrolysis of alumina dissolved in a molten salt electrolyte, comprising a plurality of substantially non-consumable anodes made of electronically conductive material resistant to the electrolyte and the anode product of electrolysis. The anodes, in use, are immersed in the electrolyte and are arranged upright or at a slope. There is also a cathodic pool of aluminium on a cell bottom having means for supplying current through the cell bottom to the cathodic pool of aluminum. The cell further comprises a plurality of upright or sloping cathode bodies made of electronically conductive material resistant to the electrolyte and to the cathodically-produced aluminium, each cathode body having, in the molten salt electrolyte, an active cathode surface facing an active anode surface and a lower part extending below the bottom of the anodes and dipping into the pool of cathodic aluminium. In use, these cathode bodies conduct current from the cathodic pool of aluminium to the cathode active surfaces where aluminium is produced and drips or downflows into the cathodic pool of aluminium.

A further inventive aspect resides in a multipolar cell for the electrowinning of aluminium by the electrolysis of alumina dissolved in a molten salt electrolyte, comprising a cell trough having a shell of thermally insulating material and a lining of refractory material making up side walls and a bottom, which refractory material is chemically resistant to the electrolyte and, at least in the region of the bottom, is also resistant to the attack of molten aluminium.

On the refractory cell bottom is a layer of aluminium, which may even be a thin layer, and on top of this a molten salt electrolyte. The cell also comprises a plurality of anodes of electrically conductive material resistant to the electrolyte and to the anode product of electrolysis, the anodes dipping in the electrolyte but being spaced above the layer of molten aluminium and being connected to means for supplying current to the anodes arranged above the top of the cell. There are also a plurality of cathodes of electrically conductive material resistant to the electrolyte and to molten aluminium, the cathodes dipping in the electrolyte and preferably extending below the anodes and into contact with the layer of molten aluminium. The cathodes also possibly extend upwardly above the top of the anodes in which case they preferably extend upwards above the means for supplying current to the anodes.

Means are arranged at the top of the cell for supplying current to the cathodes, said means optionally extending downwards and contacting the cathode inside the space within the anode bodies.

ADVANTAGES AND SPECIAL FEATURES

The electrode assembly of non-consumable anodes and cathodes, the multimonopolar cell and the electrolysis method according to the invention are distinguished from those in existing commercial Hall-Heroult cells by many features and advantages, including those enumerated below some of which, however, apply to any non-consumable, non-carbon anode or cathode, but could not be achieved in the conventional cell designs:

1. The active surface area of the anode is greater than the active surface area of the cathode, and the ratio of these areas can be set at any convenient value.

2. The current density at the anode surface is smaller than the current density at the cathode surface.

3. The overvoltage, which is important at the anode where gases are evolved, is low due to the low current density resulting from use of an anode which has a large active surface area larger than that of the cathode.

4. Oxygen formed at the inner surfaces of tubular anodes rises through the electrolyte and escapes through the top of the tubular anodes or through side openings.

5. Aluminium formed at the surface of the cathode, which is preferably made of aluminium-wettable material, drips or flows down to the bottom of the cell.

6. Aluminium collected at the bottom of the cell can be recovered continuously particularly if the bottom of the cell is inclined towards one end with a reservoir which could be provided inside or outside the electrolysis area.

7. The electrical connections to the anodes and to the cathodes of the electrode assemblies may be made at the top of the cell. For this purpose, the cathodes extend beyond the top of the tubular anodes. This would be appropriate particularly for new cell designs.

8. Gas bubbles contained in the electrolyte inside tubular anodes reduce the electrolyte density and make the electrolyte rise inside the tube, thereby efficiently circulating the electrolyte which returns outside the tube through openings in the anode tubes.

9. Tubular electrode assemblies can be placed inside the cell trough in any chosen number according to the cell capacity, the chosen anode tube size and the chosen current density.

10. The proposed configuration enables the interelectrode distance to be reduced to a minimum thanks to the rapid vertical escape of the oxygen bubbles and to the continuous dripping or downflow of the thin layer of the liquid aluminium formed on the cathode surface. The voltage drop between cathode and anode is therefore reduced considerably down to less than 20% of that in a Hall Heroult cell, thanks not only to the reduction of the interelectrode gap but also to the lower anode current density obtainable in the proposed electrode assembly (e.g. the voltage drop in the electrolyte can decrease from more than 1.5V to less than 0.3V).

11. The amount of the cathode material may be reduced to a minimum. This is especially important for costly aluminium-wettable materials.

12. The current efficiency of the process is very high due to the reduction of aluminium oxidation.

13. The concentration of the alumina in the electrolyte between the electrodes can be maintained more uniform due to the high circulation of the electrolyte, thus permitting operation at low alumina concentration such as result from electrolysis at low temperatures, and without anode effects.

14. The cathodes remain in contact with the molten aluminium at the bottom of the cell. Even if the aluminium forms a shallow layer, it will help to maintain a uniform current distribution among the electrode assemblies. The cathode rods, bars, slabs or tubes can also be supported by the cell bottom and can in turn support the anodes.

15. The cell can be provided with a thermal insulating cover so that there is no formation of electrolyte crust.

16. In new cell designs, the electrical connections of the anodes and cathodes to the source of current can be made above the cell cover.

17. The cell cover can also act as a partial support for the anodes and/or for the current distribution to the anodes. It can also be utilized for the cathode current connections and/or support.

18. For new cells, the thermal balance of the process is more favorable than in presently used Hall-Heroult cells. There is no need for heat dissipation toward the sides of the cell and the top of the cell because there is less heat production in the interelectrode gap. In fact, the usual crust formation that protects the sides of the cell from attack by the electrolyte, and the crust formation utilized as cell cover, may be unnecessary.

19. There is no need for adjustments of the anodes because there is no consumption of the anodes and no modification in the anode-cathode distance as in conventional Hall-Heroult cells.

20. For tubular electrode assemblies, the addition of alumina can be made by adding alumina powder outside the anode tubes or, when the cathodes are made of tubes, inside the cathode tubes, or by blowing through sprayers in the space between the electrolyte and the cell cover.

21. The life of the non-consumable anodes will be extended inter alia because of the low and uniform current density.

22. The anode material is much less critical than in other designs because the anode can be of small size and/or of simple shape and also because of the low and uniform current density.

23. The voltage drop from the positive busbar, through the anode, to the active anode surface is reduced from that of Hall-Heroult cells.

24. When the cathode current entry is from above, the voltage drop from the negative busbar, through the cathode, to the active cathode surface is reduced, due to the simple design and direct electrical connection.

25. Pollution due to the escape of carbon oxides and sulphur oxides is eliminated.

26. Pollution due to the formation of dangerous carbon compounds at the cathode at the bottom of the cell can be eliminated or reduced.

27. The cost of a new cell with an electrically non-conductive lining is lower and the life of the cell trough will be extended due to the simplified design and to the elimination of electrical connections.

28. In a new cell, the busbar connections are shorter and can go straight from one cell to the next.

29. The cell superstructure is greatly simplified because there is no need for continuous adjustment of the anode vertical position nor frequent replacement of anodes. The voltage drop in the superstructure is also reduced.

30. The anode design is simplified and the anode material can be ceramic thanks to this design simplification and to the small size required.

31. The anode and cathode designs are very simple and their vertical installation permits easy replacement, if necessary, of the anodes, the cathodes or of the entire electrode assemblies during operation.

32. The reduction of the total ohmic voltage drop is greater than 1 volt (which is the difference between the anodic potential for evolution of oxygen and that for formation of carbon oxides). Therefore, the total power required is smaller than that required today even for the most advanced Hall-Heroult cell designs.

33. The dimensions of tubular anodes and of cathode rods can be selected so that the voltage drop through the anode and through the cathode is limited to that required for optimization.

34. Anode tubes can be of circular or hexagonal section or other forms, and their cross-section can vary along the vertical to have quite uniform current density in the material they are made of.

35. The anodes can be made of ceramic materials or ceramic-coated metallic alloys or cermets.

36. The anode surface can be covered with an in-situ maintained protective oxycompound such as cerium oxyfluoride. The inwardly-facing concave active anode surfaces of tubular anodes ensure an excellent quality of the cerium oxyfluoride deposit.

37. The recirculation space outside tubular anodes can occupy any convenient fraction of the total horizontal cross-sectional area, for example it may occupy one-third of the surface for an arrangement of hexagonal elements (see point 48 below). The same space outside the anodes may also serve for the feed of alumina and electrolyte additives.

38. The active surfaces of the anode and of the cathode are both vertical or inclined slightly or by up to 45° to the vertical to permit better gas escape.

39. Anode tubes can be provided with variations in section to facilitate support and/or electrical connection from the top, or to provide a more uniform linear voltage drop and current supply to the surface of the anode.

10. Cathode rods can be provided with variations in section to permit support and/or electrical connection from the top, or to provide a more uniform linear voltage drop and current supply to the cathode surface.

41. The spacings between the electrode assemblies and between the anodes and cathodes can be maintained by simple means.

42. The thermal (ohmic) loss in the Hall-Heroult cell is more than half of the total power utilized, while with a cell according to this invention it is much less than half, and usually even less than one third.

43. Collection of the gas produced by electrolysis is simplified and its dilution with outside air, which cannot be avoided in Hall-Heroult cells because of the frequent anode changes, is reduced to a minimum with consequent great savings in gas purifying equipment.

44. In a new cell, the shell of the cell trough can be easily thermally insulated from outside and inside with consequent saving of energy.

45. The low anode current density enables operation even with low percentages of alumina and at temperatures lower than that used in conventional Hall-Heroult cells obtainable, by adding different compounds to the electrolyte, such as fluorides and/or chlorides. Operation at low current densities permitting low electrolyte temperatures, as taught by U.S. Pat. No. 4,681,671, prolongs life of the electrodes while the low temperature increases the life of the cell trough and particularly of the cell lining, and/or permits the use of other low-cost materials.

46. The apparent current density at the anode is very near to the real current density due to the fast escape of the gas bubbles formed and especially when the vertical dimension of the anode immersed in the electrolyte is small. As the vertical dimension of the anode immersed in the electrolyte increases, the increased bubble density towards the top, though partly compensated by an increased upward bubble velocity, decreases the electrolyte cross-section and increases the current density through that part of the electrolyte and at the surface of the anode, thereby increasing the voltage drop through the electrolyte from the bottom towards the top. Likewise the anode overvoltage (and consequently the total anode potential) also increases from the bottom towards the top. This bubble effect, therefore, provides a balancing or compensation of the voltage drop between the electrodes from their top to bottom and a more uniform current density.

47. The thickness of the tubular anode wall can be chosen at will in order to change the current density in the material for optimization.

48. Anodes of hexagonal cross-section can have all sides touching each other to form a honeycomb array. With such an arrangement, along any line of the hexagons, two in three can have cathodes and the third by having no cathode can be used for electrolyte recirculation and alumina feed. Within this array, each hexagonal recirculation space is surrounded be six hexagonal anode/cathode units. Each hexagonal anode/cathode unit has three faces connected to adjacent anode/cathode units and the other three faces adjacent a recirculation space.

49. For more uniform current density on the entire surface the interelectrode distance can be changed along the vertical axis or direction.

50. For more uniform current density in the anode and cathode materials, the thickness of the anode wall and the cross-section of the cathode can be reduced from the top towards the bottom. This also reduces the total cost of the materials for the anodes and the cathodes.

51. Cell construction, maintenance and operation costs can be reduced considerably.

52. An inclination of the anode surface towards the cathode from bottom to top will make the gas bubbles remain near its surface and reduce any possible oxidation of the aluminium.

53. The formation of alumina sludge, as between the carbon cathode and the aluminium pool in a Hall-Heroult cell, can be avoided. Furthermore, even if sludge did form, this need not affect performance.

54. There is a very large active electrode surface area per horizontal cell area with consequent high cell capacity.

55. There is a much smaller aluminum inventory in new cells made with a refractory or aluminium-wettable cell bottom lining.

56. When operating with a deep pool of molten aluminium, magneto-hydrodynamic effects are reduced due to the multimonopolar design.

57. Elimination of anode effects should save power and eliminate fluorocarbon emissions which are a concern.

58. Many of the above advantages can be obtained by retrofitting an existing aluminium production cell to a multimonopolar cell according the invention, making use of the existing busworks for current supply tot he cathodes and to the anodes.

Further features and advantages of the invention will be apparent from the following detailed description.

BRIEF DESCRIPTION OF THE DRAWINGS

The invention will be further described with reference to the accompanying schematic drawings in which.

Figure 3:
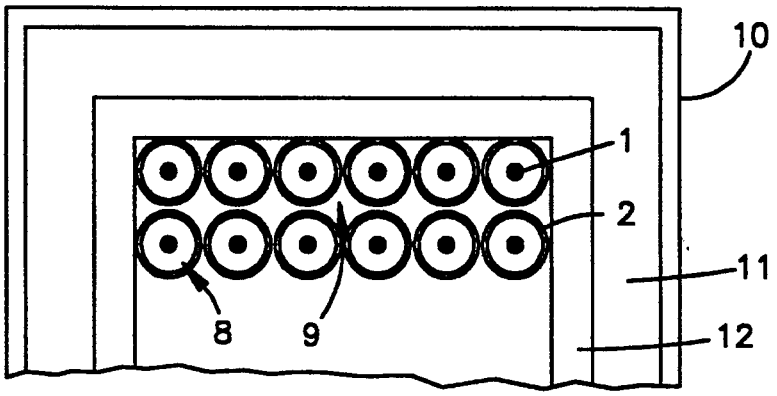
Figure 4:
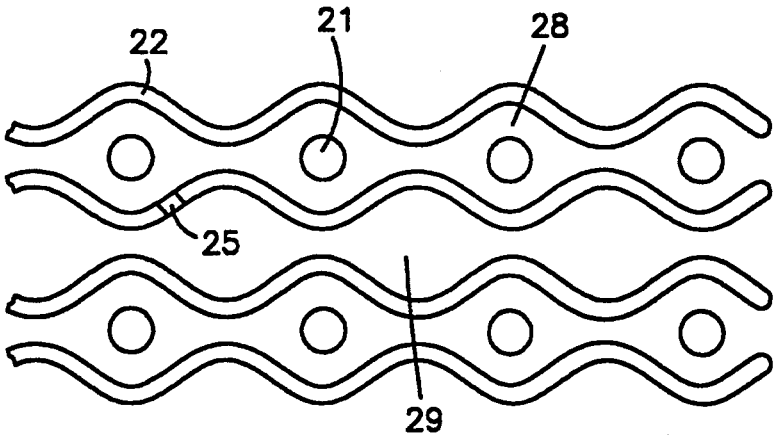
Figure 5:
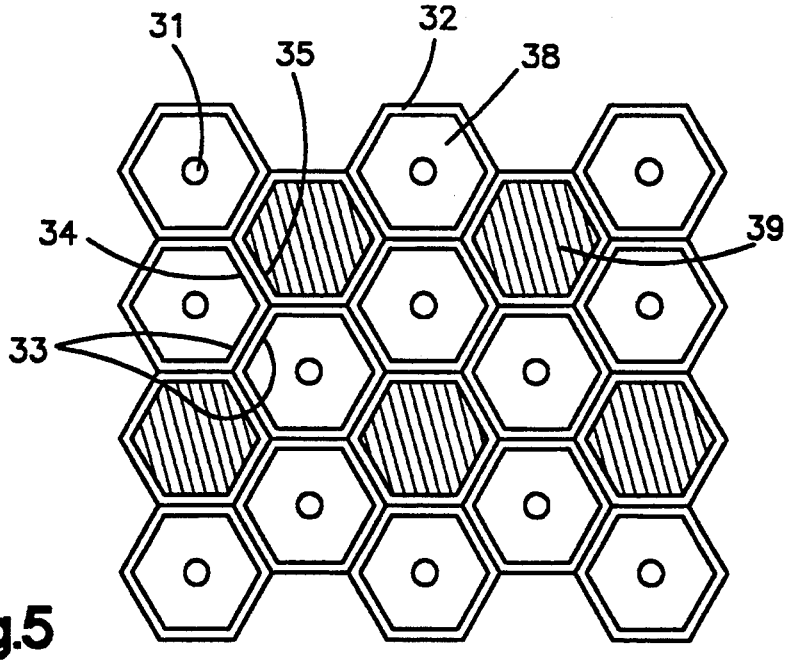
Figure 6:
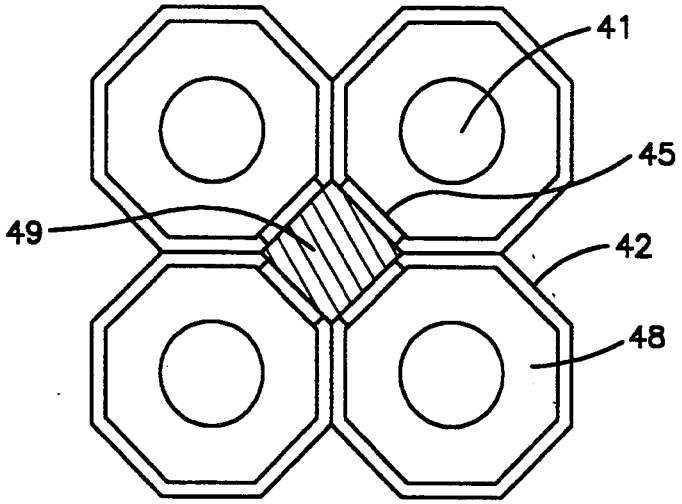
Figure 7:
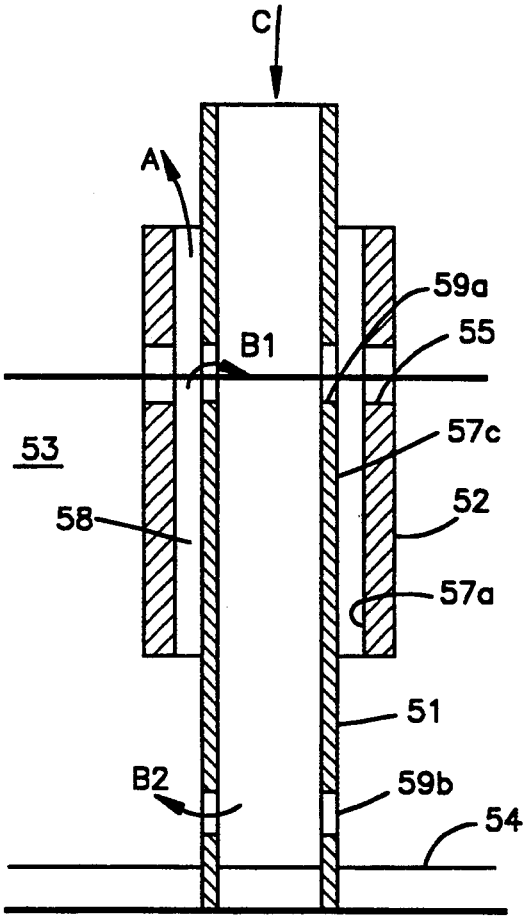
Figure 8:
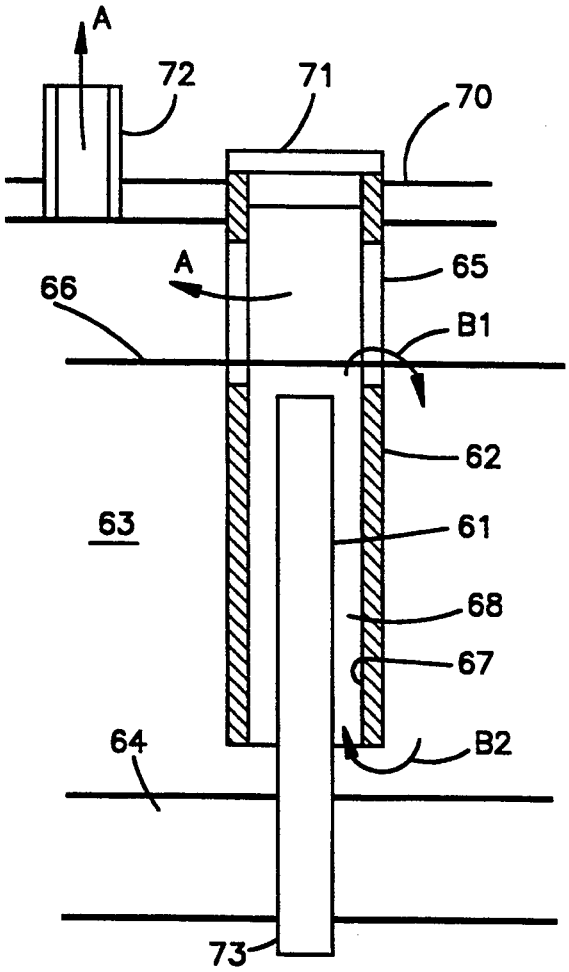
Figure 9:
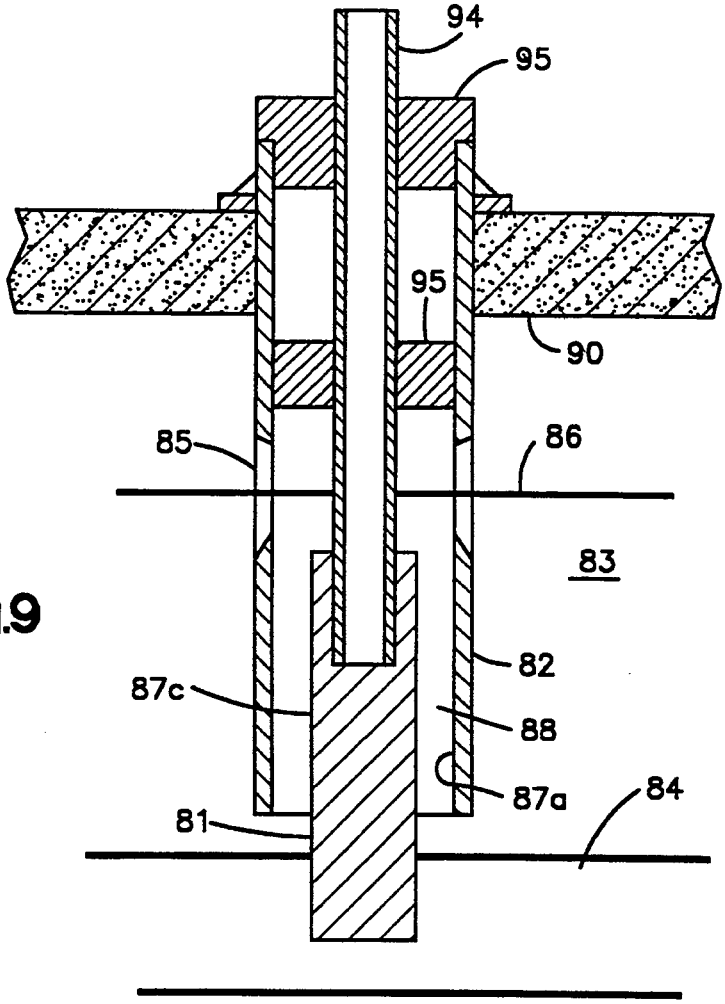
Figure 10:
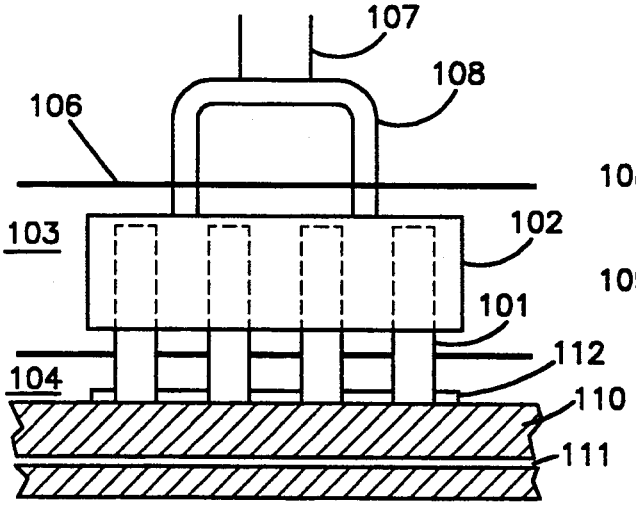
Figure 11:
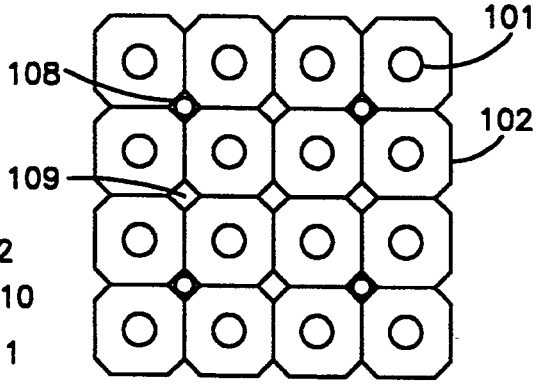
Figure 12:
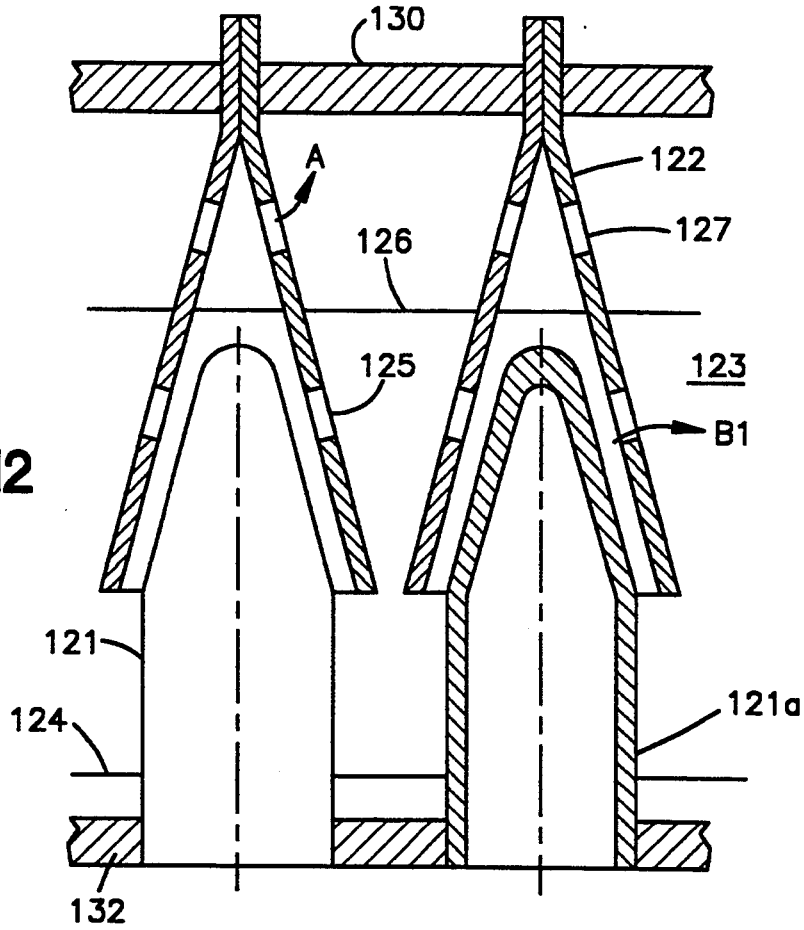
Figure 13:
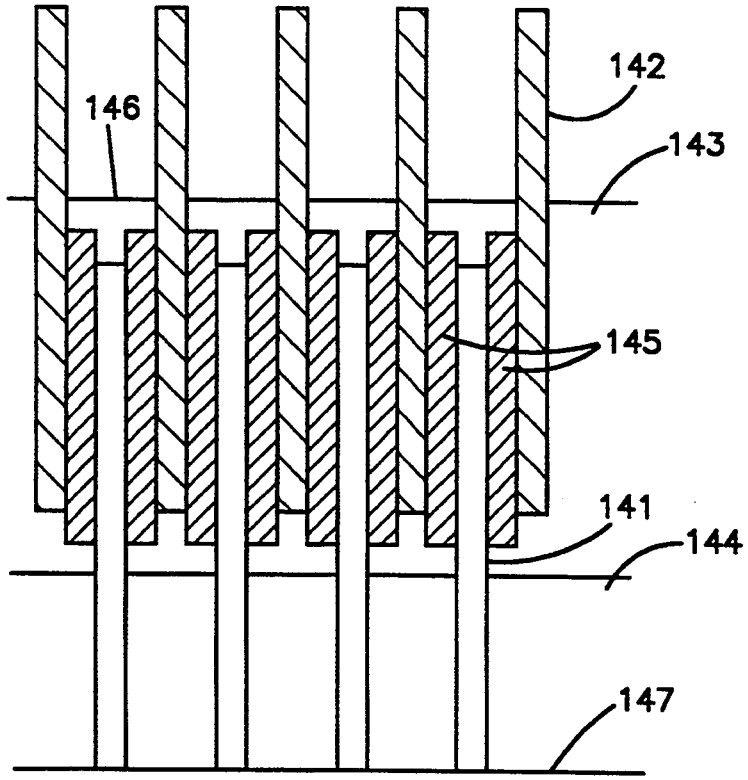

FIGS. *2a* and *2b* show parts of two multimonopolar aluminium production cells according to the invention, showing only one anode-cathode assembly in cross section for each part of the cell, FIG. *2a* showing a cell of new design and FIG. *2b* a retrofitted conventional cell;

FIG. 3 is a plan view of part of a cell like that of FIG. *2a* or *2b* having tubular anodes of circular section;

FIGS. 4 to 6 show different anode assemblies made of sections assembled together;

FIG. 7 is a vertical cross-sectional view illustrating an electrode assembly suitable for retrofitting a cell of known type having cathode current feeders in the cell bottom;

FIGS. 8 and 9 are vertical cross-sectional view of further anode-cathode assemblies making use of existing cathode current feeders in the cell bottom, wherein the anode is supported by a cell cover;

FIGS. 10 and 11 are schematic side and top views of an assembly when used for retrofitting an existing cell;

FIG. 12 is a cross-sectional view of a cell with non-tubular anode sections, and FIG. 13 is a cross-sectional view of a cell with facing anode and cathode plates having different active surface areas.

TUBULAR ELECTRODE ASSEMBLY

Figure 1:
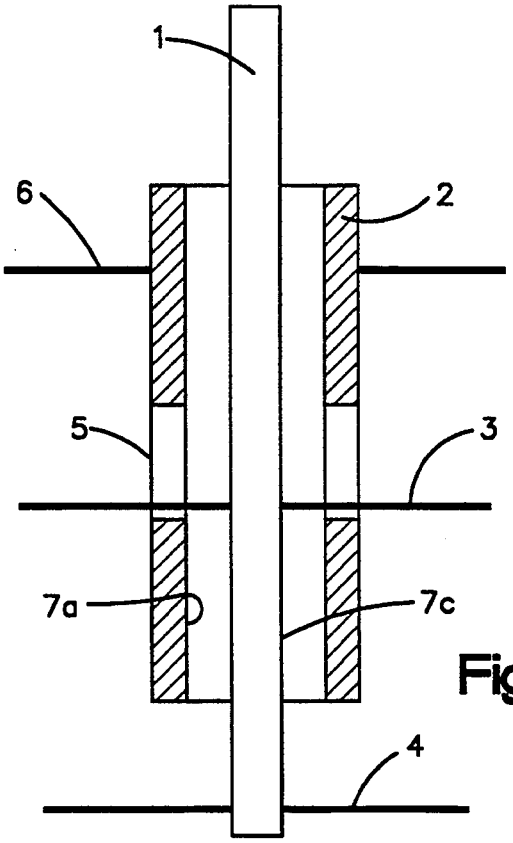
FIG. 1 is a vertical cross-sectional view illustrating an anode-cathode assembly of the invention.

The electrode assembly shown in FIG. 1 comprises a cathode rod 1 held centrally in a tubular anode section or body 2. The anode body 2 may have any suitable cross-section, such as circular, hexagonal or octagonal, and is arranged with its axis practically vertical. The centrally-arranged cathode rod 1, which is also vertical, is usually of circular cross-section, is longer than the anode body 2 and protrudes from its two open ends.

For use, the electrode assembly 1 and 2 is inserted through an opening in a diagrammatically-indicated cell cover 6 and dipped vertically into a molten salt electrolyte 3, with the lower end of a cathode rod 1 contacting a layer 4 of the collected molten aluminium. The electrolyte 3 may be molten cryolite at approximately 950° C. that contains dissolved alumina and may also contain small amounts of cerium for maintaining a protective cerium oxyfluoride layer on the active anode surface but other molten electrolytes are possible including mixed fluoride-chloride melts permitting a lower operating temperature.

In the wall of anode body 2, there are a series of openings 5 the bottom edges of which are slightly below the level of electrolyte 3. Below openings 5, inside the anode body 2, is an inwardly-facing active anode surface *7a* surrounding an active part *7c* of the associated cathode rod 1.

The anode and cathode surfaces above the bottom of openings 5 can be masked if necessary with a protective layer of chemically resistant material which does not need to be electrically conductive.

The configuration of a tubular anode body 2 surrounding a cathode rod 1 provides an active anode surface *7a* whose area is a multiple of the corresponding active surface *7c* area of the cathode. As discussed below under "Parameters of the Electrode Assembly", it is relatively easy to design the components so as to provide a desired ratio of the anode and cathode current densities, at the same time setting a desired anode-cathode gap and selecting the height of the active anode and cathode surfaces, all as a function of the various operating parameters, materials constraints and the required cell productivity per unit of the inside area of the cell trough bottom.

MULTIMONOPOLAR CELL

FIGS. *2a* and 3 show a multimonopolar aluminium-production cell of new design according to the invention, whereas FIG. *2b* shows a conventional cell retrofitted for multimonopolar operation with electrode assemblies according to the invention.

The cell of FIG. *2a* comprises a cell trough made of a shell 10 lined with bricks 11 of thermally insulating material and with an inner protective electrically insulating lining 12 of a refractory material chemically resistant to cryolite, such as mixtures containing tabular alumina. On the upper surface of the bottom of lining 12, which may be covered by a layer of material wettable by molten aluminium but in any case chemically resistant to molten aluminium, is the layer 4 of the produced molten aluminium, and above this is the molten salt electrolyte 3. On top of the cell, there is the cover 6 fitted with an inner lining 13 of thermally insulating material. By choosing the right thermic conditions in operation of the cell, the electrolyte 3 may not form a solid crust.

Into the electrolyte 3, there dip a plurality of electrode assemblies, for example like the assembly 1 and 2 described with reference to FIG. 1. At the top of cathode rods 1, above the cover 6, there are cathode current feeders 14 all extending to one side of the cell. Above cover 6, but at a level below the cathode current feeders 14 there, are anode current feeders 15 connected to the tops of anode bodies 2. Anode current feeders 15 all extend to the side of the cell opposite the cathode current feeders 14. These anode and cathode current feeders may alternatively be carried by a two-layer cell cover.

As shown in FIG. 3, the electrode assemblies 1 and 2 are arranged in the cell trough in rows in an orderly array. In the anode-cathode gap of each assembly, there is a space 8 containing alumina-enriched electrolyte to be electrolysed. Between (i.e. outside) the anode bodies 2, there are spaces 9 for the recirculation of electrolyte 3 and for the enrichment in alumina of the electrolysed bath. The adjacent anode bodies 2 may be spaced slightly apart from one another by suitable spacers, or by other means, or they may be in touching relationship.

Figure 2A:
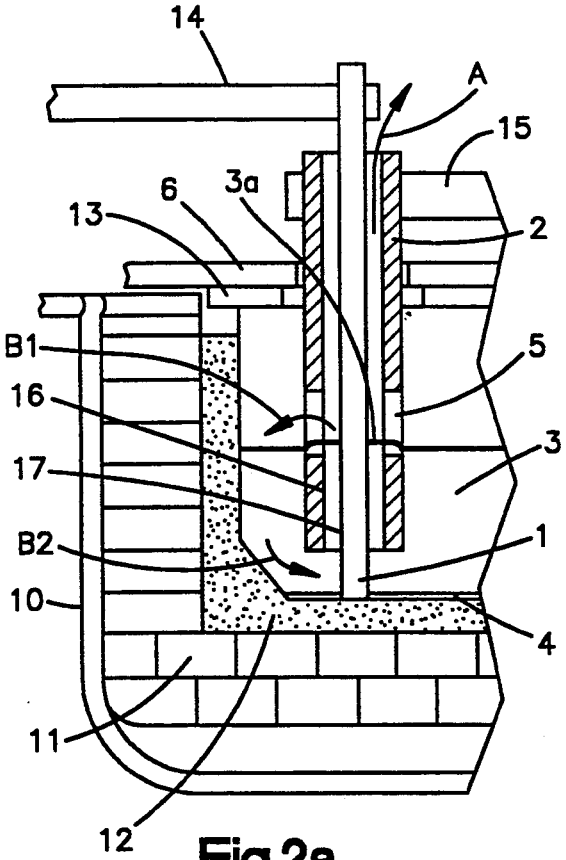
Figure 2B:
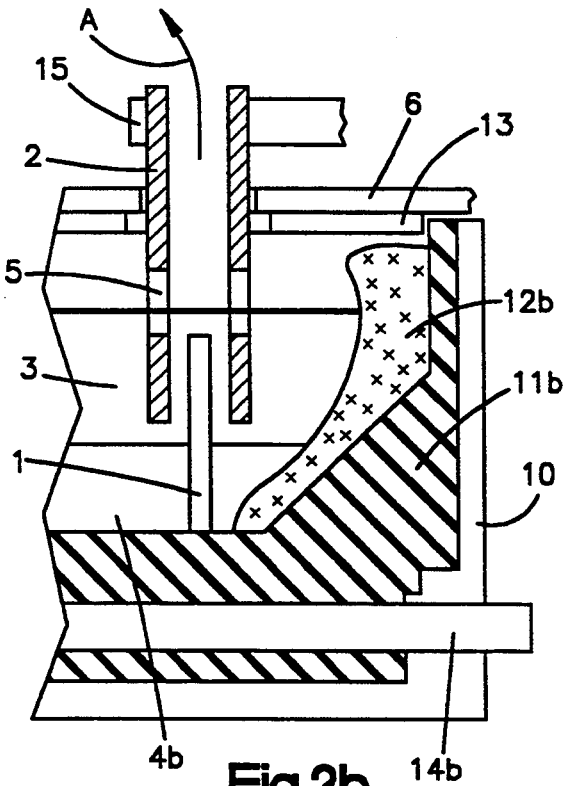

FIG. 2*b* shows a retrofitted conventional cell, wherein the same parts are designated by the same references. The conventional cell has a carbon lining 11*b* in shell 10 forming the cell bottom and sidewalls. A cathode current feeder bar 14*b* extends horizontally through the bottom of the lining 11*b* and the shell 10 to an external cathodic bus bar system. On the upper surface of the bottom of carbon lining 11*b*, there is a relatively deep aluminium pool 4*b* atop which is the molten electrolyte 3. The side walls of the cell are protected by a crust 12*b* formed of frozen electrolyte. This crust 12*b* is like that formed in conventional cells, but because of the modified thermic balance, is smaller. Into the molten electrolyte 3, there dip several electrode assemblies 1, 2 having a cathode 1 supported centrally in the lower part of a tubular anode 2 by spacers, not shown. The top of cathode 1 is below the electrolyte level, which passes through openings 5 in the anode side walls. The bottom end of cathode 1 dips in the molten aluminium pool 4*b* and may touch the carbon lining 11*a*. Thus, current is supplied to the cathodes 1 from the external bus, via current feeder 14*b*, carbon lining 11*b* and the molten aluminium pool 4*b*.

The top of each anode 2 is connected, as before, to the anodic current supply by a current feeder 15.

OPERATION

In operation of the cell of FIG. 2*a*, current is supplied to the cathode current feeders 14 and the anode current feeders 15 to produce an electrolysis reaction in the electrolyte 3 in the areas 8 surrounded by active anode surfaces 7*a*. The electrolysis reaction produces the release of bubbles 16 of oxygen on the active anode surfaces 7*a* and the formation of droplets 17 of molten aluminum on the facing surface 7*c* of cathode 1.

The oxygen bubbles 16 adjacent to the active anode surface 7*a* decrease the density of the electrolyte in space 8 and entrain it in an upward movement within the tubular anode bodies 2. As a result, the electrolyte level inside the anode bodies 2 tends to rise to a schematically-indicated level 3*a*, so that the electrolyte leaves space 8 via openings 5, as indicated by arrow B1. This generates a circulation of electrolyte 3, with alumina-enriched electrolyte entering the open bottom ends of bodies 2, as indicated by arrow B2. The oxygen leaves the open tops of anode bodies 2, outside the cell cover 6, as indicated by arrow A.

The cathodically-produced aluminium 17 drips or runs down along cathode rods 1 into layer 4 of molten aluminium. This layer 4 is kept at an approximately constant level by continuously removing molten aluminium from a location outside the area under the array of electrode assemblies 1 and 2. Alternatively, it is possible to periodically tap the aluminium, allowing a fluctuation of the level of layer 4. In either case, layer 4 helps to keep the bottom ends of the cathode rods 1 at a fairly uniform potential, thus serving to prevent the build-up of any unwanted potential differences among the cathodes.

During electrolysis, the electrolyte 3 is replenished continuously or periodically with alumina and/or electrolyte additives such as cerium compounds, for instance by spraying in alumina from the top of the cell into spaces 9 outside the tubular anode bodies 2.

Because the electrolysis takes place in the electrode assemblies 1 and 2 with a constant and small anode-cathode gap, there is a relatively smaller generation of heat in the process compared to conventional Hall-Heroult cells. The heat insulation linings 11 and 13 are sufficiently thick to maintain electrolyte 3 at a suitable operating temperature without the formation of a crust, or just below that temperature if crust formation is desired.

Operation of the retrofitted cell of FIG. 2*b* is similar. The product aluminium is removed periodically so that the level of the aluminium pool 4*b* fluctuates and, or course, the cathodic current is supplied via this pool 4*b*. The operation and advantages of this retrofitted arrangement are further explained below under the caption "Conversion of Hall-Heroult Cells by Retrofitting".

ALTERNATIVE TUBULAR ELECTRODE ASSEMBLIES

FIG. 4 shows an alternative arrangement of electrode assemblies having anode bodies 22 made of corrugated sheets which, when they are brought together with the ridges contacting one another, form a row of tubular anode compartments each containing a cathode rod 21 and with an electrolyte-containing anode-cathode space 28. Several rows made of such sections 22 can be brought together to leave therebetween electrolyte recirculation spaces 29. These bodies 22 have, at appropriate locations, openings 25 corresponding to the openings 5 of FIG. 1, only one such opening 25 being indicated. Of course, the FIG. 4 arrangement could be modified if desired by also including cathode rods 21 int he spaces designated by 29. In this case, recirculation would be provided around the periphery of the outermost anode sections 22.

FIG. 2 shows a honeycomb array of hexagonal electrode assemblies. Each electrode assembly comprises a hexagonal anode body 32 in which there is a central cathode rod 31 and an electrolyte space 38 in the anode-cathode gap. In the array, three walls 33 of each anode body 32 are adjacent to three corresponding walls 33 of three adjacent anode bodies. The other three walls 34 of each anode body 32, which alternate with walls 33, are adjacent to three walls 35 of hexagonal recirculation spaces 39 in which there is no cathode. Hexagonal bodies made by walls 35 are not necessary because the recirculation and alumina feeding spaces 39 may be formed by walls 34.

Each hexagonal recirculation space 39 inside the array is thus surrounded by six electrode assemblies 31 and 32. Along each line of the hexagons, two of each three hexagons form electrode assemblies 31 and 32 and the remaining hexagon is a recirculation space 39. The recirculation spaces 39 thus account for one third of the total horizontal area of the array.

Walls 34 and, if present, walls 35 have openings therein at a suitable height, like the openings 5 of FIGS. 1 and 2, so that electrolyte circulation can take place between the electrolyte spaces 38 inside the tubular anode bodies 32 and the recirculation spaces 39.

In the hexagonal arrangement of FIG. 5, half of the anode walls 33 are effectively operating from both faces, and to maintain an uniform current density in the anode walls, double thickness should be provided when the anodes are not made by single separate bodies.

Another cellular arrangement of electrode assemblies is shown in FIG. 6, this time made of octagonal anode bodies 42 each containing a central cathode rod 41 and with an electrolysis space 48. Between the sides of four adjacent anode bodies 42 is left a space 49 of square cross-section for electrolyte recirculation and alumina replenishment. Openings 45, like opening 5 of FIG. 1, are provided in the four faces of section 42 that lead into the recirculation space 49, or the upper edge of these four faces is simply lower than the upper edge of the other four faces of the anode sections 42. In this octagonal arrangement, the recirculation spaces 49 account for about 20% of the total horizontal area of the array.

Obviously, the arrangements of FIGS. 5 and 6 could be made up of sections, like the sections 22 of FIG. 4, but of appropriate shape so as to form hexagonal or octagonal compartments.

Other similar cellular arrangements are possible with different shapes and made up either of individual units or of sections which when assembled form several tubular anode sections and an arrangement of recirculation spaces.

Further alternative non-tubular electrode assemblies are described later.

FIG. 7 shows an electrode assembly wherein each cathode is a tube 51 placed at the center of a tubular anode body 52, having an outer active cathode surface 57*c* facing the active anode surfaces 57*a*. Towards the top of the active cathode surface 57*c* one or more openings 59*a* are provided in the wall of the tubular cathode 51, which openings 59*a* serve in use for the circulation, from the inside of tubular space 58 to the inside of tubular cathode 51, of electrolyte 53 entrained by anode-evolved gas. These tubular cathodes 51 can thus serve for electrolyte circulation and alumina feed, with alumina-enriched electrolyte returning inside the anode section through one or more openings 59*b* provided towards the bottom of the tubular cathode wall.

As shown, the bottom end of cathode 51 dips into layer 54 of molten aluminium and rests on the cell bottom. This arrangement is suitable for retrofitting existing Hall-Heroult cells where it is desired to make use of the existing connections in the cell bottom for supplying current to the cathodes 51 via the layer or pool of molten aluminium 54.

The electrode assembly may be supported from above, with the cathode tube 51 suspended in the anode tube 52 by spacers, not shown, or it is possible to fix the bottom ends of the cathode tubes 51, in supports in or on the cell bottom.

In use, oxygen evolved at the anode active surface 57*a* escapes as indicated by arrow A, the evolved gas entraining electrolyte circulation according to arrows B1 and B2. Alumina is fed into the hollow cathodes as indicated by arrow C, continuously or intermittently, at a rate to compensate for the alumina depletion by electrolysis.

FIGS. 8 and 9 show two more electrode assemblies where the anode, or the entire electrode assembly, is suspended from a cell cover.

In FIG. 8, the upper ends of tubular anodes 62 are closed by caps 71 and fitted in a cell cover 70. The anodes 62 have openings 65 above the tops of cathode rods 61. The level 66 of electrolyte 63 extends above the tops of cathode rods 61 and through the openings 65, so that evolved oxygen can escape through these openings as indicated by arrow A and then pass through an exhaust pipe 72 in cover 70.

The bottom end of cathode rod 61 dips in the molten aluminium 64 and is supported in a recess 73 in the cell bottom. Alternatively, it could be fixed in a holder placed on the cell bottom.

Operation is similar to before, with upward movement of electrolyte induced in the anode-cathode space 68 producing electrolyte circulation according to arrows B1 and B2, and with the electrolyte level 66 remaining substantially constant part way along the openings 65. The evolved oxygen from several electrodes assemblies is collected and removed via pipe 72.

In FIG. 9, an anode tube 82 is suspended from an insulated cell cover 90 and a cathode rod 81 is held inside the anode tube 82 by a support tube 94 fitted in insulating spacers 95, maintaining an even anode-cathode gap 88 between the active anode and cathode surfaces 87*a*, 87*c*. The bottom end of cathode rod 81 dips in molten aluminium 84, without touching or being supported by the cell bottom. Anode tube 82 has openings 85 extending above the top of cathode rod 81. The height of the cover 90 is arranged so that the level 86 of electrolyte 83 passes through these openings 85.

Usually, the cathode support tube 94 is made of insulating material, and supply of current to the cathode 81 takes place through the cell bottom and layer 84 of molten aluminium. It would alternatively be possible to supply current to the cathode 81 via a tube 94 or rod of conductive material.

In this embodiment, the cover 90 can have an oxygen exhaust pipe, as shown in FIG. 8.

MATERIALS

The anode sections may advantageously be made of a composite ceramic-protected metal structure as described in EP-A-0,306,089, made of a nickel-chromium based alloy substrate having an oxidized alloy of copper and nickel on its surface which serves to anchor an in-situ maintained cerium oxyfluoride layer. But other alloy anode substitutes can be used.

It is also possible to make the anode bodies of ceramic materials, e.g. ceramic oxide spinels, in particular ferrites as described in European Patent EP-B-0,030,834, or cermets. For ceramic materials, it would be preferable to have arrangement with individual electrode assembly units as in FIGS. 1, 5 and 6.

The cathodes may be made of titanium diboride or other chemically and thermally resistant materials such as aluminium-wettable RHM (refractory hard metal) materials. Although titanium diboride is expensive, because of the design of the electrode assemblies and the way they operate, relatively small quantities of the cathode material are needed and high grade material may not be required. It is also possible to use known composite materials containing RHM in combination with a refractory material, or composites of RHM with graphite, carbon, aluminum, etc. Such materials can be used because the new cell design lends itself to easy replacement of the cathodes, so that a long cathode lifetime is not critical.

The cell lining 12 is preferably composed predominantly of packed tabular alumina, e.g. it may be composed of various grades of alumina powder packed in successive layers, or some layers may be mixtures of tabular alumina with cryolite or other materials. At or near the top may be a layer of dense tabular alumina having coarse and fine fractions, as taught in EP-A-0,215,590.

The optional aluminium-wettable top layer on cell lining 12 may be powdered $TiB_2$ or other RHM material sprinkled on and compacted into the surface. Or this layer may be formed of tiles or slabs of RHM or composites based on RHM, e.g., the $TiB_2.Al_2O_3$ composite described in U.S. Pat. No. 4,647,405. A very advantageous material for this layer is the aluminium-wettable but electrically non-conductive material described in EP-A-0,308,014, made of a slab or tile of fused refractory alumina having in its surface a multiplicity of discrete inclusions of aluminium-wettable RHM, e.g. $TiB_2$.

An important feature of the cell made possible by the electrode assembly with anode as well as cathode current feed from the top, is the fact that the inside of the cell trough can be made entirely of electrically non-conducting material with no current feeders in the trough. This simplifies cell construction considerably, reduces the cost of the cell and extends the lifetime of the cell trough. All of these advantages can be obtained when it is desired to build a completely new cell.

However, for retrofitted cells, the existing carbon cell lining can be retained. Retrofitting is also possible for cells still having cathode current feeder bars but with the cell bottom only partly made of carbon or made totally of non-carbonaceous material and with bottom entry current feeders made for example of refractory hard metals.

CONVERSION OF HALL-HEROULT CELLS BY RETROFITTING

If it is desired to make use of existing cell hardware, such as the cell trough and associated cathode current feeder buswork, in order to save capital expenditure, many advantages of the invention can be achieved by a simple retrofit operation whereby the existing cell is converted to multimonopolar operation, as illustrated schematically in FIG. 2*b*. For this, the electrode assemblies are designed so that the current supply to the cathode takes place by dipping of the cathode rod, bar, tube or plate into the cathodic layer of molten aluminium. Suitable electrode assemblies have already been described in connection with FIGS. 1, 7, 8 and 9 in conjunction with FIGS. 4, 5 and 6.

The principle of this cell conversion is that the existing anodes, usually pre-baked carbon blocks or Soderberg-type anodes, together with part of their superstructure, are removed from the cell and replaced with a set of electrode assemblies according to the invention and with an appropriate simplified superstructure taking into account that it will no longer be necessary to continually adjust the anode height to account for anode consumption. However, adjustments may still be required to account for large fluctuations in the level of the aluminium pool. The effect of this conversion is to change the cell from operation with a single monopolar cathode, formed by a deep aluminium pool which is subject to wave motions and other disadvantages, to operation as a multimonoplar arrangement where each electrode assembly forms a distinct cell operating with a constant and narrow gap. Therefore, although the deep pool of molten aluminium remains, the associated disadvantages are avoided and the average depth can be decreased.

FIGS. 10 and 11 illustrate an example of cell retrofitting, although it is understood that this arrangement could also be used in new cells.

An existing Hall-Heroult cell with a carbon cell bottom 110 incorporating cathode current supply bars 111 is converted to multimonoplar operation by replacing the existing anodes and superstructure with the illustrated arrangement in accordance with the invention. In the aluminium layer 104 on cell bottom 110, there is placed a cathode support structure 112 in the form of a plate or lattice which holds several upright cathode rods 101 aligned in rows. As shown in FIG. 11, the cathode rods 101 are arranged in parallel rows equally spaced apart from one another, so that each cathode rod 101 fits centrally in an anode compartment 102.

A multiple anode assembly, made up of an array of cellular compartments 102, in this example octogonal compartments, supported by a current feeder 107 and a cradle formed of anode current feeder bars 108, is lowered into the electrolyte 103 until the cellular anode compartments 102 are fully submerged below the electrolyte level 106 and come to fit around the cathode rods 101 as shown.

In this multiple anode assembly, at the intersection of the octogonal anode compartments 102, there are square openings. Some of these square openings are reserved for electrolyte recirculation spaces 109 and others, which are located in alternate rows and which alternate with the recirculation spaces 109, are reserved for fixing the anode current feeder bas 108. Thus, a cellular arrangement with 4×4 anode compartments 102, as shown, is supported by four anode current feeder bars 108 suspended from the current feeder 107.

In operation, the gas lift in the anode compartments 102 causes an upward circulation of the electrolyte therein, which is compensated by a downward circulation in spaces 109.

When servicing of the cell becomes necessary, for example to exchange the cathode rods 101, this can be accomplished simply by lifting up the entire assembly of cathode rods 101 usually with their support structure 112, by gripping the tops of the cathode rods, possibly using the anode structure for this. A new cathode structure can then be fitted as before, and operation resumed.

Of course, any suitable number of the described arrangements of appropriate sizes can be used to retrofit the cell.

ALTERNATIVE NON-TUBULAR ELECTRODE ASSEMBLIES

The above-described embodiments with tubular anode bodies can be modified while remaining generally tubular. For instance, in the embodiment of FIG. 4, the anode sections 22 can have their closest points spaced apart. Also, substantially cylindrical anodes as in FIG. 1 and FIGS. 7 to 9 can be made of several sections leaving gaps so that the anode sections almost completely surround the cathode.

Many of the advantages of the described electrode assemblies and retrofitted multimonopolar cells can also be obtained with electrode assemblies employing non-tubular anodes or anode sections, for instance upright or inclined anode plates which are spaced apart on either side of a row of upstanding elongate cathodes, or cathode plates.

FIG. 12 shows a cell with upstanding cylindrical cathodes 121 having tapered tops arranged in spaced-apart rows perpendicular to the plane of the Figure. The tapered tops of the cathodes 121 are lodged under respective pairs of anode plates 122. Each pair of anode plates 122 thus forms a steeply-inclined roof over the row of cathodes 121. At their tops, the plates 122 of each pair are joined together and pass through a cell cover 130 where the protruding tops of the plates 122 are connected to an anode current supply (not shown). The anode plates 122 have a series of openings 125 below the level 126 of electrolyte 123, for the circulation of electrolyte according to arrow B1, and series of openings 127 above the electrolyte level 126, for the release of oxygen, indicated by arrow A. The oxygen then leaves by a chimney in the cover 130.

The bottom ends of cathodes 121, which dip in molten aluminium 124, are held on the cell bottom by a removable support 132. The cathodes 121 can be cylindrical with frusto-conical generally hemi-spherical top ends, or of cylindrical or rectangular cross-section with inclined flats on their top ends.

The anode plates 122 can be flat or undulated to fit around the tops of the cathodes 121 with a more constant anode-cathode gap.

The cathodes 121 can be solid bodies, as shown in the left-hand part of FIG. 12, or hollow bodies 121*a* as shown in the right-hand part of FIG. 12, and can have any suitable cross-section, in particular circular, polygonal, or rectangular.

Thus, the cathodes 121 can be hollow or solid plates, with tapered top ends, these plates extending all or part of the way along the inclined anode plates 122. It is greatly preferred to have an increased active anode surface area. To achieve this, the anode plates 122 can be made of porous material, e.g. with a skeletal structure, or may have ribs, louvers or any other configuration increasing their active surface area in relation to their normal geometrical surface area.

FIG. 13 shows another cell design with anodes and cathodes in the form of plates. In this cell, vertical cathode plates 141 and anode plates 142 are held apart in spaced parallel relationship by spacers 145. The cathode plates 141 extend downwardly from the bottom of the anode plates 142 and dip in a pool 144 of cathodic aluminium on the cell bottom 147. This cell bottom 147 contains bars (not shown) for the supply of current to the cathode.

The tops of the cathode plates 141 are located below the level 146 of electrolyte 143.

The anode plates 142 extend up on from the top of the cathode plates 141, to above the electrolyte level 146, and are connected by any convenient means to buswork, not shown, for supplying anodic current. The level of the aluminium pool 144 may fluctuate in use, but always remains below the bottom of anode plates 142.

The spacers 145 occupy only a small part of the facing anode/cathode surfaces, leaving the main part of these facing surfaces separated by an electrolysis space containing electrolyte 143. Again, it is greatly preferred to have an increased active anode surface area, and to achieve this, the anode plates 142 may for example be made of porous, reticulated, skeletal or multicellular material, or may be ribbed, louvered or otherwise configured to increase their active surface area relative to their geometrical area.

The cathode plates 141 are normally solid. If, however porous cathode plates are used, their porosity preferably will be such as to maintain the active anode surface area greater than the active cathode surface area. Preferably the ratio of the active anode surface area to the active cathode surface area will be at least 1.5:1 and may be as high as 5:1 or more. Maintaining a high ratio of the active anode/cathode surface areas is helpful in operating the anodes at a low current density. This increases the life of the anodes, and enables the use of materials that cannot withstand operation at high current densities for long periods. The relatively lower cathode surface area means a saving in the costs for the cathode materials. This is very significant when RHM materials like titanium diboride are used. The described cell configuration also leads to a high productivity of aluminium per unit area of the cell bottom, because large facing anode cathode plates can be used. These advantages are available when operating at "low" temperatures, less than 900° C. using special electrolytes, or when operating at "normal" temperatures of 900° C. or more.

PARAMETERS OF THE ELECTRODE ASSEMBLIES

An electrode assembly may consist of, as previously described, an anode in the form of a tube of circular cross-section and an inner cathode in the form of a rod (or of a tube of smaller diameter than the inner diameter of the anode, which tube can optionally be filled with a metal or an alloy having high electrical conductivity). Both anode and cathode can, in this case, be made of ceramics of chosen size and thickness. To choose the dimensions of the electrodes, the current densities chosen for the active surface of the anode and of the cathode are a determining factor. The current densities in the anode and cathode materials are other factors which are set according to the characteristics of the materials and the acceptable voltage drop.

The total height of the anode and of the cathode depends upon the height of the anode and of the cathode immersed in the electrolyte and the total depth of the cell trough. The height of the anode immersed in the electrolyte is chosen according to the electrical conductivity of the material of which the anode is made and the acceptable current density at the anode surface with the goal to arrive at a required current density relative to the horizontal projection of the assembly.

An example with illustrate the calculation.

A cylindrical anode having an external diameter of 9 centimeters (cm) and a thickness of 1.5 cm will have an internal diameter of 6 cm. If the inter-electrode distance is chosen to be 1.5 cm, the required diameter of the cathode is 3 cm. The following Table I gives data for four electrode assemblies for operation at 125, 250, 500 and 1000 Amp. The cathodes utilized for operation at 125, 250 and 500 Amp are solid rods while the cathode for operation at 1000 Amp is a tube having an outer diameter of 15 cm and an inner diameter of 12 cm. The "projected horizontal area" is the projected horizontal area occupied by an electrode assembly assuming a 0.5 cm spacing on each side between adjacent assemblies. The term "CD" is an abbreviation for current density. The Table is self-explanatory for the additional data.

Similar calculations can be made for electrode assemblies of other sizes and shapes and for cases in which the anode is made of an alloy protected by one or more ceramic layers.

TABLE I

ELECTRODE ASSEMBLY FOR OPERATION AT 125, 250, 500 AND 1000 AMP

| Amp/Electrode Assembly | | 125 | 250 | 500 | 1000 |
|---|---|---|---|---|---|
| Anode external diameter | cm | 9 | 11 | 14 | 24 |
| Anode thickness | cm | 1.5 | 2 | 2 | 2.5 |
| Anode Internal diameter | cm | 6 | 7 | 10 | 19 |
| Anode-cathode distance | cm | 1.5 | 1.5 | 2 | 2 |
| Cathode diameter | cm | 3 | 4 | 6 | 15/12 |
| Anode inner circumference | cm | 18.8 | 22 | 31.4 | 59.7 |
| Cathode outer circumference | cm | 9.4 | 12.6 | 18.8 | 47 |
| Anode section | $cm^2$ | 35.3 | 56.5 | 75.4 | 168 |
| Cathode section | $cm^2$ | 7.1 | 12.6 | 28.3 | 63.6 |

TABLE I-continued

| ELECTRODE ASSEMBLY FOR OPERATION AT 125, 250, 500 AND 1000 AMP | | | | | |
|---|---|---|---|---|---|
| Amp/Electrode Assembly | | 125 | 250 | 500 | 1000 |
| CD inside anode material | $A/cm^2$ | 3.5 | 4.4 | 6.6 | 5.9 |
| CD inside cathode material | $A/cm^2$ | 17.6 | 19.8 | 17.7 | 15.8 |
| Anode length immersed in electrolyte | cm | 15 | 25 | 35 | 35 |
| Active anode surface | $cm^2$ | 282 | 550 | 1100 | 2090 |
| Anode CD | $A/cm^2$ | 0.44 | 0.45 | 0.45 | 0.48 |
| Active cathode surface | $cm^2$ | 141 | 315 | 658 | 1645 |
| Cathode CD | $A/cm^2$ | 0.89 | 0.79 | 0.76 | 0.61 |
| Projected horizontal area of Electrode Assembly | $cm^2$ | 100 | 144 | 225 | 625 |
| CD per projected horizontal area | $A/cm^2$ | 1.25 | 1.7 | 2.2 | 1.6 |

I claim:

1. A multimonopolar cell for the production of aluminum by the electrolysis of alumina dissolved in a molten salt electrolyte, comprising a plurality of substantially non-consumable anodes made of electronically conductive material resistant to the electrolyte and to anodically produced oxygen and substantially non-consumable cathodes made of electronically conductive material resistant to the electrolyte and to cathodically produced aluminium, said cell having a top and bottom with means for supplying current to the anodes from the top of the cell and the cathodes extending downwardly beyond the anodes and in electrical contact with the cell bottom, the anodes and cathodes are placed substantially upright or at a slope in the cell whereby, in use, cathodically produced aluminum downflows to the cell bottom while anodically produced oxygen escapes towards the top, characterized in that the anodes and cathodes are arranged as electrode assemblies electrically connected in parallel, each electrode assembly comprising one or more cathodes having an active cathode surface facing and surrounded by or in between an inwardly-facing active anode surface of at least one anode, said inwardly-facing active anode surface having an area which is greater than an area of active surface of the facing cathode, said at least one anode surrounding or forming an enclosure around said cathode and having at least one opening in an upper part thereof for the release of anodically evolved oxygen.

2. The cell of claim 1, wherein the cathodes dip into a cathodic pool of aluminium on the cell bottom.

3. The cell of claim 2, wherein the cathodic pool of aluminium is stop a cell bottom provided with means for supplying current to the cell bottom and from there to the cathodes via the cathodic pool of aluminium.

4. The cell of claim 1, wherein the cathode or a cathode current feeder protrudes above the electrolyte level and a top part of the surrounding anode and is connected to means arranged at the top of the cell for supplying current to the cathodes, and wherein at least a part of the cathode or the cathode current feeder is made of or coated with a material resistant to the anode product of electrolysis.

5. The cell of claim 1, wherein the cathode is an elongate piece or tube arranged centrally in a tubular anode.

6. The cell of claim 5, wherein the cathodes are tubular and have openings in their walls for the circulation of electrolyte promoted by anodically-evolved oxygen.

7. The cell of claim 1, wherein the anode is a tubular piece with openings in its wall or with an open top end below the electrolyte level, for the circulation of electrolyte promoted by anodically-evolved oxygen and for the escape of oxygen.

8. The cell of claim 1, wherein a plurality of tubular anodes are arranged in side-by-side relationship with electrolyte recirculation spaces between the anodes and under the anodes.

9. The cell of claim 8, wherein the anodes are formed as multiple anode assemblies made of a plurality of sections juxtaposed into a cellular structure having an array of tubular cavities.

10. The cell of claim 1, wherein the cathodes are supported on the cell bottom by a holder which is removable from the cell together with the cathodes.

11. The cell of claim 1, wherein the cathodes are supported by the anodes.

12. The cell of claim 1, wherein the cathodes are supported from the top of the cell.

13. The cell of claim 1, wherein at least one of the active anode and cathode surfaces is at a slope of no more than 30° to the vertical.

14. The cell of claim 1, wherein the electrolyte contains cerium ions and the anode has a protective coating of cerium oxyfluoride.

15. The cell of claim 1, wherein the cathodes and anodes have cross sections and specific resistivity chosen so that the linear vertical resistance of both the cathode and the anode are substantially equal.

16. A multiple anode assembly for use in the production of aluminium by the electrolysis of alumina dissolved in a molten salt electrolyte in the multimonopolar cell of claim 1, said anode assembly comprising a plurality of sections made of substantially non-consumable electronically conductive material resistant to the electrolyte and to the anode product of electrolysis, which sections are juxtaposable into a cellular structure having an array of tubular cavities, at least some of the tubular cavities having on their inside an inwardly-facing active anode surface of an elongate cathode inserted therein when the anode assembly is in use.

17. A substantially non-consumable anode for use in the cell of claim 1, for the production of aluminum by the electrolysis of alumina dissolved in a molten salt electrolyte, the anode comprising at least one tubular body made of electronically conductive material resistant to the electrolyte and to the anode product of electrolysis and having on its inside an inwardly-facing active anode surface made predominantly of cerium oxyfluoride, or having an inwardly-facing surface which is an anchorage for in-situ deposited or maintained cerium oxyfluoride, which active surface, when the anode is in use, surrounds a cathode arranged along the middle of the tubular anode body, each tubular anode body having an open upper end for the release of evolved oxygen and having an open lower end for the intake of circulating electrolyte.

18. The anode of claim 17, wherein towards the top of the active anode surface of each tubular anode body is an opening in the wall of the tubular anode body, which opening may extend to the top of the wall of the tubular anode body, said opening serving in use for the circulation, from inside to outside the tubular anode bodies, of electrolyte entrained by anode-evolved oxygen.

19. The process of using the cell according to claim 1 wherein there is carried out electrowinning of aluminum, by electrolysis of alumina dissolved in a molten salt electrolyte, at temperatures below 900° C.

20. The process of using the cell according to claim 19, wherein electrolysis current is passed between an upright or sloping cathode surrounded by or facing at least one upright or sloping anode body of each electrode assembly, with current supplied to the anodes from the top and to the cathodes frm the bottom, with a current density at the inwardly-facing active anode surface inside the surrounding anode body or bodies which is less than the current density of the cathode surface, oxygen evolved at the active anode surface passes through an open top of the anode body or bodies or side openings in the anode body between the anode bodies, entraining with it an upward flow of electrolyte which generates circulation of the electrolyte, and aluminum produced on the cathode surface drips or flows to the bottom and is collected in a pool into which the cathodes dip.

21. The process of using the cell of claim 20, wherein the anode active surface area and the current applied thereto are such that the resulting anode current density is substantially lower than the limiting anode current for oxygen evolution so that oxygen can be produced preferentially to fluorine or other gases even for low concentrations of alumina dissolved in the molten salt electrolyte.

22. The process of using the cell of claim 20, wherein the electrolyte circulates downwards in at least one circulation space outside the anodes or inside tubular cathodes.

23. The process of using the cell of claim 20, wherein the electrolyte contains cerium ions containing a protective coating of cerium oxyfluoride on the surface of the anode.

24. The process of using the cell of claim 19, comprising a cathode of given specific resistivity and an anode of given specific resistivity in combination with a molten salt electrolyte of specific resistivity, wherein the cross-sections and the spacing of the cathode and anodes are chosen so that for any given current path between the anode and cathode the voltage drop remains substantially constant.

25. A method of converting, to operation as a multimonopolar cell, an electrolytic cell for the production of aluminium by the electrolysis of a molten salt electrolyte containing dissolved alumina, comprising a plurality of anodes which in use are immersed in the molten salt electrolyte above a cathode pool of aluminium on a cell bottom having means for supplying current through the cathodic pool of aluminium, said method comprising replacing the existing anodes with a plurality of electrode assemblies as set out in claim 1.

* * * * *